United States Patent [19]

Weaver, Jr.

[11] 4,228,552

[45] Oct. 21, 1980

[54] BATHTUB WALL-SURROUND

[75] Inventor: Charles S. Weaver, Jr., Evansville, Ind.

[73] Assignee: Peerless Pottery, Inc., Evansville, Ind.

[21] Appl. No.: 693,143

[22] Filed: Jun. 7, 1976

Related U.S. Application Data

[63] Continuation of Ser. No. 544,869, Jan. 29, 1975, abandoned.

[51] Int. Cl.[3] ..... A47K 3/00; A47K 3/16

[52] U.S. Cl. ..... 52/35; 4/546; 4/576; 4/567; 52/520

[58] Field of Search ..... 4/2–5, 4/146, 148, 173, 175, 177, 185 H, 191, 173 R, 192, 177 R, 149; D23/57, 69; 52/34, 35, 493, 489, 543, 520, 771, 288

[56] References Cited

U.S. PATENT DOCUMENTS

| | | | |
|---|---|---|---|
| 2,399,151 | 4/1946 | Tickle | 52/493 X |
| 2,672,831 | 3/1954 | Fink et al. | 52/543 |
| 2,694,813 | 11/1954 | Cartwright | 4/185 H |
| 3,588,925 | 6/1971 | Kuypers | 4/173 |
| 3,606,712 | 9/1971 | Moir | 52/35 |
| 3,977,136 | 8/1976 | Daniels | 52/35 |
| 3,978,529 | 9/1976 | Krafft | 4/2 |

*Primary Examiner*—Stuart S. Levy

*Attorney, Agent, or Firm*—Warren D. Flackbert

[57] ABSTRACT

A wall-surround, as for a bathtub, defined by multi-interconnected panels, and featuring holding members and/or grab bars secured by threaded means to conventional studding of the framework of the structure behind the wall-surround panels.

3 Claims, 5 Drawing Figures

BATHTUB WALL-SURROUND

This is a continuation of application Ser. No. 544,869, filed Jan. 29, 1975, now abandoned.

As is known, existing bathtub and/or shower installations typically include the use of ceramic tile on the walls defining the space above a bathtub or within a shower stall. One drawback to such existing ceramic tile arrangements is the possibility of mildewing, or, at least, special maintenance to insure an attractive appearance.

In contrast to the use of the aforesaid ceramic tile, or alternatively, individually laid plastic tile, presently available wall-surrounds also utilize panels of plastic, typically positioned through the use of an adhesive. Again, difficulties were inherent by the preceding, in that, oftentimes, the panels would loosen and become unsightly.

Another objection to plastic panels has been the poor safety factor of a commonly used grab bar. In other words, the grab bars, typically secured to the plastic panels, or forming a part of the plastic panels, represented a weak supporting structure for an individual.

The present invention overcomes the aforesaid problems by providing a sectionalized wall-surround arrangement, the respective sections or panels being clipped together and made watertight. Importantly, vertical grab bars are provided which are positioned by threaded means extending through openings in the panels and into conventional portions of building structure disposed behind the panels. Thus, a rigid structure is afforded, not being dependent upon a use of adhesive material, insuring a greater strength or support for the use of an individual.

Aside from the preceding, the installed panels are attractive, readily cleaned, and assume any desired final aesthetic configuration. As a matter of choice, a corner defined by the panels is presented as a continuous bend, meaning the absence of a seam which, in turn, oftentimes creates a maintenance problem.

A better understanding of the present invention will become more apparent from the following description, taken in conjunction with the accompanying drawing, wherein FIG. 1 is a view in front elevation showing a bathtub wall-surround in accordance with the teachings of the present invention;

Figure 1:
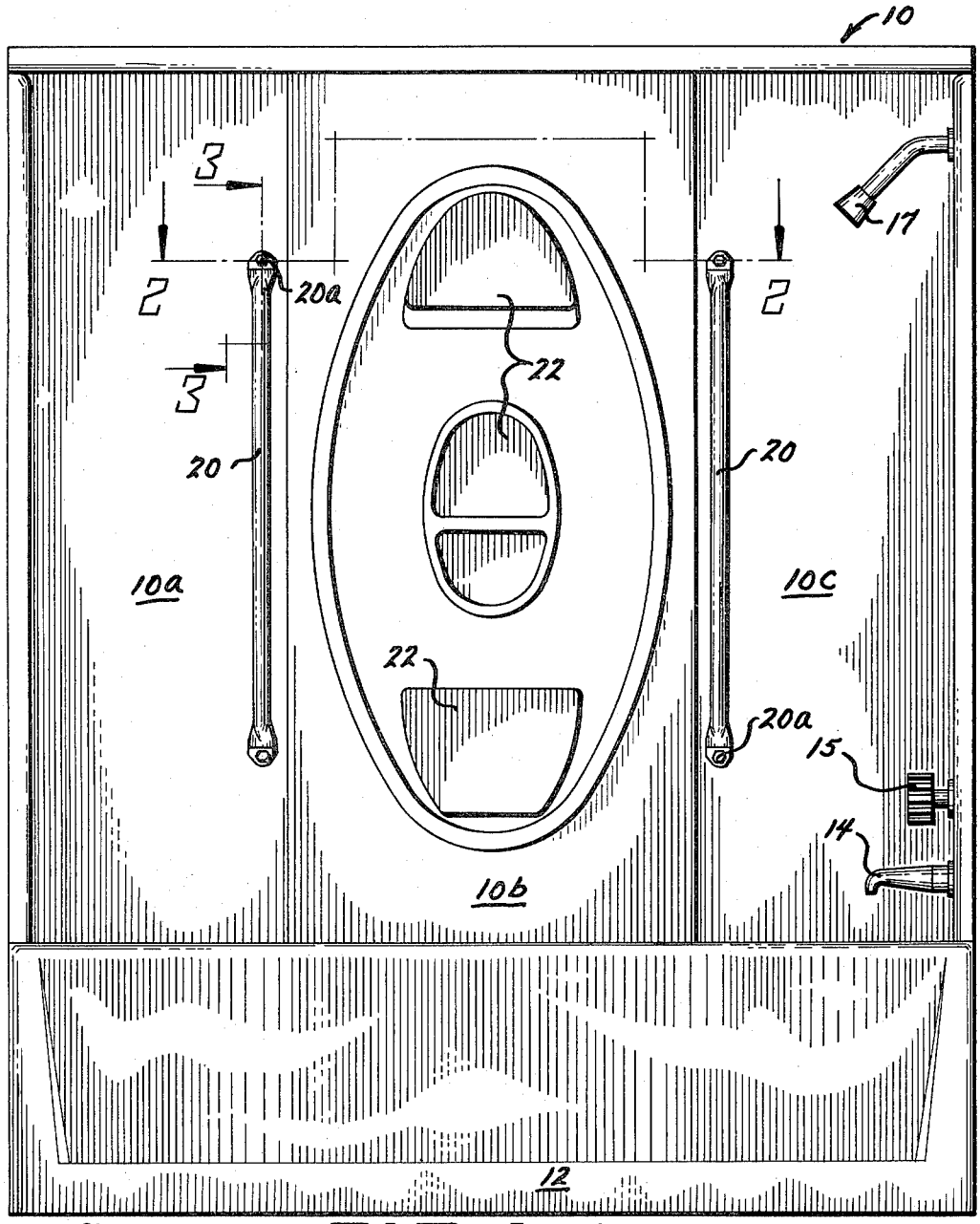

For the purposes of promoting an understanding of the principles of the invention, reference will now be made to the embodiment illustrated in the drawing and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the figures, the wall-surround 10 defining the invention is shown in a typical installation including a bathtub 12. In a preferred form, the wall-surround 10 is defined by three panels or sections, viz. end section **10*a*, center section 10*b* and another end section 10*c*. Typically, each of the aforesaid panels is formed from an extruded acrylic plastic material, backed by a plastic of the A.B.S. class. In any event, each of the end panels 10*a* and 10*c*** may include a continuous bend to define a corner, which arrangement presents no seam and, therefore, is watertight and provides ease in cleaning.

As is evident from the drawing, various forms of plumber's brass may be employed, as, for example, a water faucet 14, water control knob(s) 15, a shower head 17, support members or grab bars 20, and soap or article receiving portions 22, where each of the preceding are positioned for convenience and blend to provide a desired aesthetic appearance.

Figure 3:
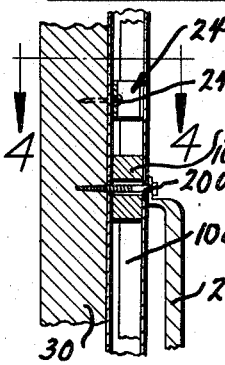
FIG. 3 is a view in vertical section, taken at line 3—3 of FIG. 1 and looking in the direction of the arrows, showing further details of the aforesaid securing arrangement.
Figure 2:
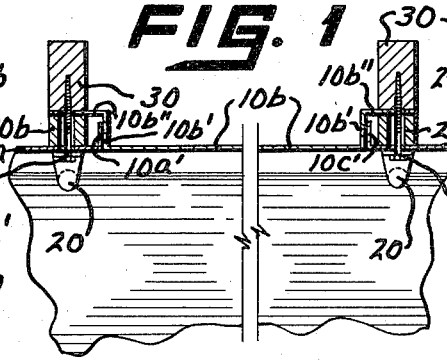
FIG. 2 is a view in horizontal section, taken at line 2—2 of FIG. 1 and looking in the direction of the arrows, showing details relative to securing the support members or grab bars in position.

An important feature of the invention, particularly shown in FIGS. 1, 2 and 3, is the assembly of the aforesaid grab bars 20. In this connection, and typically, the end panels **10*a* and 10*c* are predrilled to receive threaded means 20*a*, such as screws, which extend through openings at opposite ends of each grab bar 20, spacer blocks 20*b* and into conventional studding 30 extending vertically behind the wall-surround 10 and forming part of the building framework. In other words, the grab bars 20 are positively positioned, being firmly secured to a permanent part of the wall structure and, thus, providing ample strengthening to support the hand of a user or any desired article. In other words, the invention does not rely upon the previous approach of utilizing adhesive means for positioning the wall-surround 10**.

Figure 4:
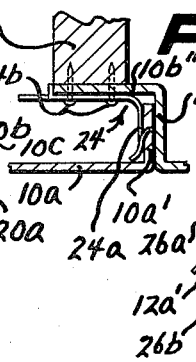
FIG. 4 is a view in horizontal section, taken at line 4—4 of FIG. 3 and looking in the direction of the arrows, showing a typical assembly for interconnecting respective panels of the wall-surround; and, FIG. 5 is a view in vertical section, partly broken away, showing a panel in mounted position with relation to a bathtub.
Figure 5:
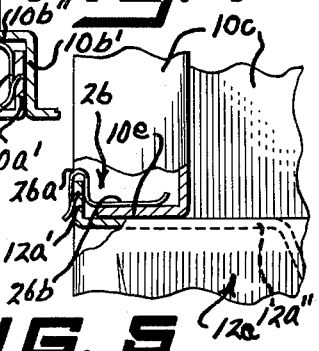

FIGS. 3, 4 and 5 are representative of the means employed for interconnecting and positioning the panels **10*a*, 10*b* and 10*c*. As evident in FIGS. 3 and 4, each end panel 10*a* and 10*c* has inturned side edges 10*a*′ and 10*c*′, respectively, while the center panel 10*b*, although reversed depending upon the side involved, includes inturned portions 10*b*′ and back portions 10*b*″, the latter parallel to the plane of the front surface of the wall-surround 10**.

In this connection, FIG. 4 should be noted particularly for representing the use of clip 24, secured in position by threaded means **24*b*, as screws, which extend through portion 10*b*″ of the center panel 10*b* and into the studding 30. In order to accomplish an effective seal, side edges 10*a*′ and 10*c*′ of end panels 10*a* and 10*b*, respectively, are each urged between a portion 24*a* of the clip 24 and inturned portion 10*b*′ of center panel 10*b*, where, typically, an adhesive (not shown) is employed between such inturned portion 10*b*′ of center panel 10*b* and inturned side edges 10*a*′ and 10*c*′ of panels 10*a* and 10*c***, respectively, to prevent water seepage.

With reference now to FIG. 5, an approach is shown for positioning a bottom or lower edge **10*e* of the panels 10*a*, 10*b* and 10*c* with respect to a wall 12*a* of bathtub 12, the latter having an upturned edge 12*a*′ mounting a portion 26*a* of a clip 26. Bottom or lower edge 10*e* of each of the panels 10*a*, 10*b* and 10*c* is received between a portion 26***b* of the clip 26 and top surface 12*a*" of wall 12*a* of the bathtub 12.

It should be understood that any desired number of clips 24 may be employed to interconnect the panels 10*a*, 10*b* and 10*c*, and, additionally, any desired number of clips 26 are utilized to position the aforesaid panels with respect to bathtub 12.

From the preceding, therefore, it should be apparent that the invention is readily installed, where security is provided by the direct positive placement of the vertical grab bars or support members, which, at the same time, also firmly position the wall-surround 10. Additional positive positioning is achieved by the use of the described clips.

In any event, the wall-surround is susceptible to various changes within the spirit of the invention, as in proportioning, style of clips, and in outward finished appearance. The invention provides an important contribution to safety as well as maintenance for a wall arrangement surrounding a bathtub or a shower stall, or, as a matter of fact, a wall-surround for any desired end use. Thus, the preceding description should be considered illustrative and not as limiting the scope of the following claims:

I claim:

1. A wall-surround installed on wooden studding comprising a first panel and a second panel each having substantially coplanar front surfaces and where a side edge of said first panel and an adjacent side edge of said second panel are in a spaced-apart overlapping relationship to define a receiving space, a spacer block disposed within said receiving space, a grab bar, and threaded mounting means for said grab bar extending through said first panel, said spacer block, said second panel and into said wooden studding in an assembled relationship.

2. The wall-surround of claim 1 where fastening means secure said first panel and said second panel together, where said fastening means is a resilient member disposed within said receiving space and secured to said wooden studding through said side edge of said first panel, and where said side edge of said second panel is retained between a portion of said resilient member and another portion of said side edge of said first panel.

3. The wall-surround of claim 1 where a surface including an upstanding edge mounts said first panel, where fastening means interconnect said first panel and said mounting surface, where said fastening means is a resilient member positioned on said upstanding edge, and where a bottom edge of said first panel is retained between a portion of said resilient member and said mounting surface.

* * * * *